United States Patent [19]

English et al.

[11] 4,183,444

[45] Jan. 15, 1980

[54] LID HAVING INTEGRAL HANGER

[76] Inventors: Roy L. English; Irene F. English, both of 2733 SE. 31st, Portland, Oreg. 97202

[21] Appl. No.: 929,810

[22] Filed: Jul. 31, 1978

[51] Int. Cl.[2] ..... B65D 35/44; B65D 43/00; B65D 51/00

[52] U.S. Cl. ..... 220/200; 220/85 R; 220/23.4

[58] Field of Search ..... 220/200, 85 R, 306, 220/23.4, 23.86, 380; 229/43, 7 R, 1.5 B; 206/806

[56] References Cited

U.S. PATENT DOCUMENTS

| | | | |
|---|---|---|---|
| 3,138,432 | 6/1964 | Kleinhans | 206/806 X |
| 3,401,825 | 9/1968 | Weiss | 220/306 |
| 3,421,681 | 1/1969 | Frank | 229/43 |
| 3,815,281 | 6/1974 | Kander | 220/23.4 X |
| 4,091,953 | 5/1978 | Daenen | 220/23.86 |

*Primary Examiner*—George T. Hall
*Attorney, Agent, or Firm*—Chernoff & Vilhauer

[57] ABSTRACT

A plastic lid for a drink cup has an integral hanger arranged for engaging a hole or slot placed in a small container for food such as fried chicken, french fried potatoes, etc., for ease in carrying both the covered drink cup and the food container in one hand. The hanger either extends upwardly from the top of the lid or is a part of a flap depending from a rim of the lid. The lid is manufactured from sheet plastic stock material by integrally forming the lid member and the hanger by heat and pressure, and a plurality of the lids may be simultaneously formed, with the hook members formed from material which lies between adjacent lids, thus using otherwise wasted material.

12 Claims, 10 Drawing Figures

90°

LID HAVING INTEGRAL HANGER

BACKGROUND OF THE INVENTION

This invention relates to improvements in removable lids for food and drink cups. French fries and other foods which are contained in small bags or cardboard containers are often purchased together with drinks such as milkshakes or carbonated soft drinks, particularly by patrons of "fast-food" or "carry-out" restaurants.

Although bags or boxes are usually provided to contain an entire order for several people, each individual patron must thereafter hold his own individual servings. Particularly when one is walking or is riding in an automobile, this becomes awkward or difficult, since one hand must be used to hold the drink cup, and the bag of french fries, onion rings, etc., must be precariously held between two fingers or between a finger and the drink cup, while the other hand is used to remove the food from the small container. Therefore, a simple, effective means of supporting both a drink cup and a small food container in one hand is needed to facilitate carrying a drink and a food container simultaneously while walking or while riding in an automobile.

Covers for drink cups have been provided by many of the restaurants serving "fast-food", to prevent spillage of drinks. The lids are typically formed of plastic by the use of a vacuum-molding process which produces a circular lid having a generally flat cover member which is attachable to the drink by means of an annular retaining rim and a downwardly extending cylindrical portion which fit snugly over the top of the drink cup. The molding process is normally used to simultaneously produce a plurality of such covers from a single sheet of stiff plastic material. Accordingly, when the formed lids are cut apart and removed from the sheet they leave a matrix of plastic sheet material which is thus wasted. Even in the most economical arrangement of the circular lids on a sheet of plastic stock, the wasted area is significant; thus there is a considerable amount of plastic material, now wasted, which is available for additional use.

After forming and separation, the drink container lids are usually stacked and shipped to the end user, who then separates the lids and individually places them on containers filled with soft drinks, milkshakes, etc. Often the same people who fill and cover the soft drink cups also take orders, receive payment for the food and drinks served, and make change for patrons, and in the process inevitably occasionally touch the bottom or inner side of the drink cup lids, thus making the lids unsanitary.

SUMMARY OF THE INVENTION

The novel drink cup lid of the present invention answers the above needs for a simple, economical means of more easily carrying both a drink and a food container and reducing the amount of plastic wasted in production of drink cup lids, by providing a means of attaching a food container, such as a bag for french fries or fried onions, to the drink cup, thus allowing a person to easily carry both the food and the drink in one hand, leaving the other hand free to hold individual pieces of the food. The present invention accomplishes these ends by providing either an upwardly pointing spike or a hook which is integrally formed with the plastic lid used by "fast-food" restaurants to prevent spills from the drink cup.

In some embodiments of the invention part of the material previously wasted in manufacture of the drink cup lids is used for forming the hanger. The area of plastic stock defined between adjacent circular drink cup lids which are closely arranged in a multiple-lid mold is vacuum formed along with the lid into a dependent flap attached to the outer portion of the retaining rim of the lid. The flap is simultaneously formed to include one of a number of possible hook-like or hook-including configurations. The lids are then cut apart so as to leave the flap and its therein-contained hook attached to the lid instead of leaving the material behind as waste.

In another embodiment of the invention a hollow spikelike closed-ended tubular plastic spike extends upwardly from the rim portion of the plastic drink cup lid. This spike may be formed by adding a similarly shaped portion to the mold used to form the lid.

In either embodiment a food container may be attached to the lid by means of the hanger. The small food container having an opening punched near its top is placed on the spike or hook formed in a drink cup lid, to hang alongside the drink cup. The weight of the drink contained in such a drink container is generally enough to overcome any balance problem caused by the weight of the food generally held in one of these small food containers. When served, this allows the drink cup to be carried or set down on a table, with the food attached thereby overcoming the current problem of spillage that plagues fry containers. Use of the invention thus reduces the amount of energy and material used in production of separate containers such as the cardboard boxes presently used to carry orders to a patron's table or automobile.

The dependent flap member may also be used as a handle to remove individual lids from the stack in which the lids are sent to the restaurant. A restaurant employee can grasp the flap to separate individual lids from a stack without having to touch the inner side of the lids, thus preserving the sanitary condition of the lids, and protecting the restaurant patrons from germs carried on currency handled by the restaurant employee in the normal course of business.

Therefore it is a principal objective of this invention to provide an inexpensive simple means for simultaneously carrying a drink cup and a food container in one hand thereby reducing spillage from the containers.

It is a further objective of the invention to reduce the amount of plastic material wasted in the production of sheet plastic drink cup lids.

It is yet a further objective of the invention to provide a means of sanitary handling of drink cup lids by "fast-food" restaurant employees.

It is a feature of the invention that it provides a method for producing drink cup lids which enable a person to easily carry a drink cup and a container of food in one hand.

DETAILED DESCRIPTION OF THE INVENTION

Figures 1, 2, 3, 4, 5, 6, 7, 8, 9, 10:
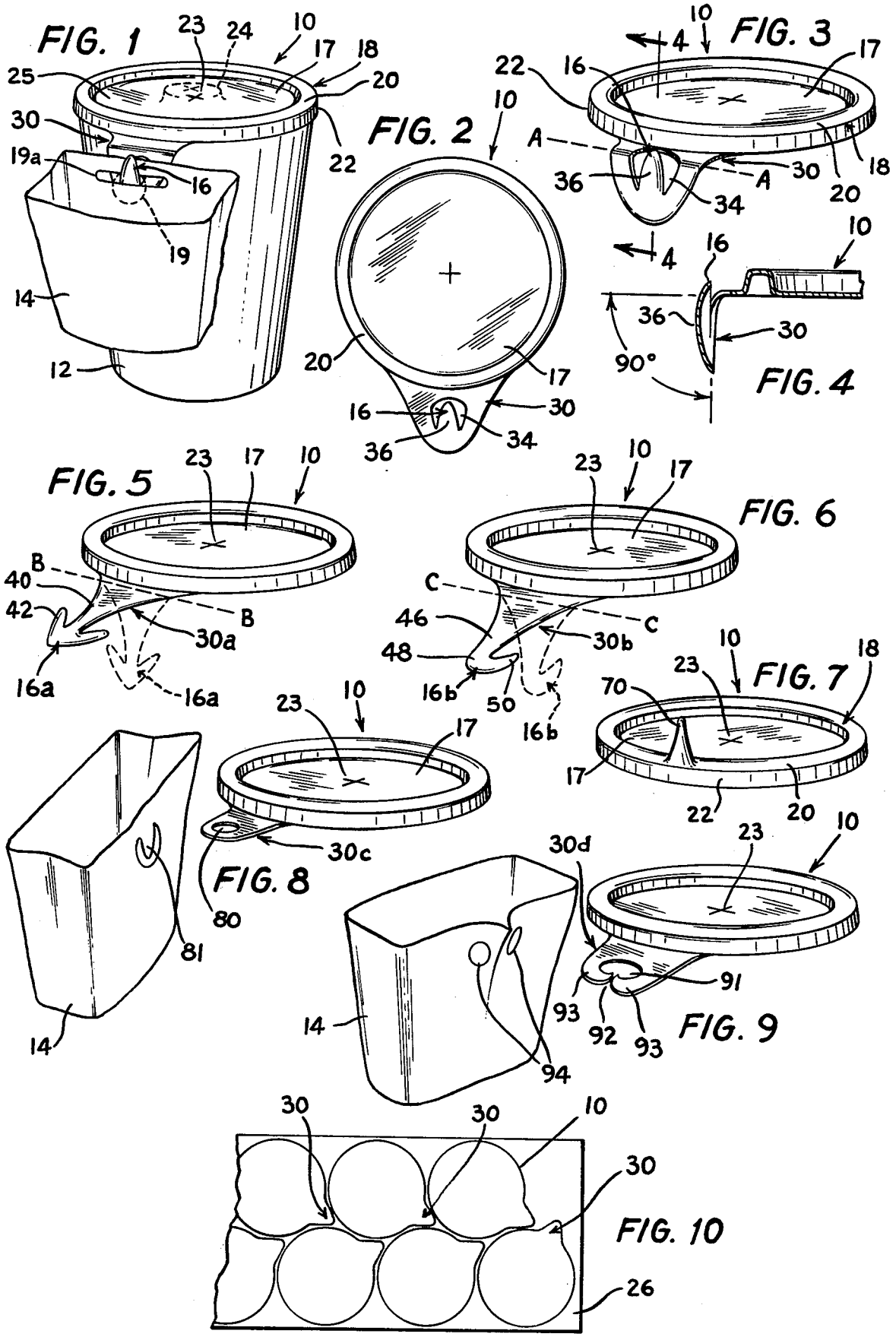
FIG. 1 is a perspective view of a lid which is a preferred embodiment of the present invention with a french fry container attached.
FIG. 2 is a plan view of the lid of FIG. 1 showing an inverted "U" cut in the flap.
FIG. 3 is a perspective view of the lid of FIG. 1 after having been bent down from the weight of the food container.
FIG. 4 is a fragmentary sectional view taken on the line 4—4 in FIG. 3.
FIG. 5 is a perspective view of a lid which is another embodiment of the invention.
FIG. 6 is a perspective view of another embodiment of the invention.
FIG. 7 is a perspective view of a different lid embodying the invention.
FIG. 8 is a perspective view of yet another embodiment of the invention
FIG. 9 is a perspective view of yet a further embodiment of the invention.
FIG. 10 is a plan view of an arrangement of a plurality of lids made on one sheet of stock according to the invention.

Referring to FIG. 1, a perspective view of the invention in use is seen, wherein the lid 10 of the present invention is shown on a food and drink cup 12 of the type used by "fast-food" restaurants, and a bag or box of french fries 14 is shown engaged through a slot 19*a* or hole phantom 19 to lid 10 by means of an integral flap 30 and hook 16. The lid 10 is comprised of a circular covering member 17, circumscribed by an annular retaining rim 18 having a radially disposed portion 20, and a downwardly extending cylindrical portion 22 depending from and circumscribing the radially disposed portion 20. An "X"-shaped cut 23 in the circular covering member 17 allows a drinking straw to be inserted through the lid, as is well known in the art, however, it could be raised as shown in FIG. 1 at 24 in phantom line, thereby providing a surrounding depression 25 for catsup, etc.

As large numbers of drinking cup lids are formed simultaneously in arrangements on a large sheet 26 of plastic material, as shown in FIG. 10, it is seen that a considerable amount of material remains as excess from the circular shape of the lids. The amount of such excess material is least when the arrangement shown in FIG. 10 is used, but even then it is still appreciable. In FIG. 10, it is seen that a trilateral area of such excess material remaining after formation of circular lids 10 may be used to advantage as an integrally formed flap 30 left attached to the lid 10. Previously wasted material from the plastic sheet 26 is thereby used, and, as the resulting lids 10 may still be stacked for shipment, there is no inconvenience caused by the addition of the flaps to the lids 10. Additionally, the flap 30 may be used as a handle to allow restaurant workers to remove a single lid from a stack of several and place it on a drink cup without touching and contaminating the side of the lid which will be exposed to the drink in the cup.

Referring first to the embodiment shown in FIGS. 2, 3 and 4, the flap 30 defines an inverted "U"-shaped opening 34, with the hook 16 comprising a tongue 36 extending upwardly between the downwardly pointing legs of the inverted "U" of the opening 34, and the marginal sides of the tongue 36 and the sides of the "U" portion of the flap are rolled slightly toward one another, forming curved spine shapes giving additional strength to the tongue and flap. The tongue 36 forms an upwardly extending hook when flap 30 is bent at line A—A downwardly approximately 90° as shown in FIGS. 3 and 4.

Referring to FIG. 5, another embodiment of the invention is seen, wherein a flap 30*a* has the form of an arm 40 and a pair of triangular tabs 42 extend laterally from the extremity of the arm 40. Since the tabs 42 may be bent resiliently toward each other when the hook 16*a* is inserted through an opening in a food container, this embodiment of the invention may be used to securely attach to the lid 10 a food container having a small hole or slot. The hook is shown in phantom bent downward 90° at line B—B.

Referring to FIG. 6, a third embodiment of the invention is seen, wherein a flap 30*b* forms a downwardly depending "J"-shaped hook 16*b* which is integral with cylindrical portion 22 of retaining rim 18 and is oriented generally parallel to the side of the drink cup 12. The "J"-hook comprises an outwardly extending member 46, a laterally curving section 48 integral therewith, and an inwardly extending point 50 integral with the laterally curving section 48 and of shorter length than the downwardly extending member 46. Again the hook is shown bent downwardly 90° along line C—C, from the weight of a food container.

Referring to FIG. 7 a perspective view of another lid embodying the invention is seen. Integrally formed with and extending upwardly from the radially disposed portion 20 of the retaining rim 18 is an elongate, hollow, spikelike hanger member 70, used to hangingly attach a food package to lid 10. Hanger member 70 may be formed simultaneously with the formation of the lid 10, which is commonly formed from a sheet of plastic material shaped by the use of vacuum molding techniques. A simple alteration of the mold for the lid 10 includes the shape of the hanger member.

Another embodiment of the invention is shown in FIG. 8 where flap 30*c* is provided with a hole 80 and a box type food container is provided with a hook 81 which is formed as a "U" shaped opening.

A final embodiment shown in FIG. 9 comprises a flap 30*d* having a hole 91 and a slot 92, thereby forming two opposed hooks 93 which engage two holes 94' which are formed in the food container.

The terms and expressions which have been employed in the foregoing abstract and specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A removable lid for a food and drink cup, comprising:

(a) cover means for covering the open top of the cup;

(b) annular retaining rim means joined to the periphery of said cover means for circumscribing the top of the cup and retaining said lid in position thereon;

(c) hanger means integral with said retaining rim means for engaging an opening defined in a food container; and (d) a food container defining hole means therein, said hole means arranged for cooperating with said hanger means so that said food container is carried by said lid.

2. The lid of claim 1 wherein said rim means includes a radially disposed portion and a cylindrical portion depending from the periphery of said radially disposed portion and said hanger means comprises hook means dependently connected to and integral with said cylindrical portion for hangingly attaching a food container to said lid by engaging an opening defined in said food container.

3. The lid of claim 2 wherein said hook means comprises a flap defining an inverted "U"-shaped opening therein and having a tongue extending upwardly between the downwardly-extending legs of said inverted "U"-shaped opening, said tongue being formed into a protruding hook having a "U"-shaped cross-section.

4. The lid of claim 2 wherein said hook means comprises a downward-pointing arm and a pair of tabs extending laterally and backwardly from the extremity thereof.

5. The lid of claim 2 wherein said hook means comprises a generally "J"-shaped member including a downwardly extending member, a laterally curving member integral therewith, and an upwardly extending point integral with said laterally curving member and of shorter length than said downwardly extending member.

6. The lid of claim 2 wherein said hook means is comprised of two opposed hooks facing each other for engaging openings in said food container.

7. The lid of claim 2 wherein said hook means is comprised of a flap with a hole to engage a hook or protrusion formed in said food container.

8. The lid of claim 1 wherein said retaining rim means includes a radially disposed portion and a cylindrical portion depending from the periphery of said radially disposed portion and said hanger means comprises an elongate, upstanding, hollow, spikelike member integral with said retaining rim means and extending substantially normal to said radially disposed portion thereof, for hangingly attaching a food container to said lid by engaging a hole defined in said food container.

9. A removable lid for a food and drink cup, comprising:

(a) cover means for covering the open top of the cup;

(b) an annular retaining rim means joined to the periphery of said cover means, for surrounding the top of the cup and holding said lid securely in place thereon, said rim having a radially disposed portion and a downwardly extending cylindrical portion circumscribingly integral therewith;

(c) a flap dependent from and integral with said cylindrical portion; and (d) an elongate hollow hook member extending outwardly and upwardly from said flap, for engaging a food container by means of a hole defined therein and hangingly attaching the food container to said lid.

10. The lid of claim 1 including a raised portion in said cover means, providing a platform for a drinking straw opening.

11. A removable lid for a food and drink cup, comprising:

(a) cover means for covering the open top of the cup;

(b) an annular retaining rim means joined to the periphery of said cover means for circumscribing the top of the cup and retaining said lid in position thereon, said rim means including a radially disposed portion and a cylindrical portion depending from the periphery of said radially disposed portion;

(c) hook means dependently connected to and integral with said cylindrical portion for hangingly attaching a food container to said lid by engaging an opening defined in said food container; and (d) said hook means comprising a flap defining an inverted "U"-shaped opening therein and having a tongue extending upwardly between the downwardly-extending legs of said inverted "U"-shaped opening, said tongue being formed into a protruding hook having a "U"-shaped cross-section.

12. A removable lid for a food and drink cup, comprising:

(a) cover means for covering the open top of the cup;

(b) an annular retaining rim means joined to the periphery of said cover means for circumscribing the top of the cup and retaining said lid in position thereon, said rim means including a radially disposed portion and a cylindrical portion depending from the periphery of said radially disposed portion;

(c) hook means dependently connected to and integral with said cylindrical portion for hangingly attaching a food container to said lid by engaging an opening defined in said food container; and (d) said hook means comprising a downward-pointing arm and a pair of tabs extending laterally and backwardly from the extremity thereof.

* * * * *